US008800224B1

(12) United States Patent
Kharshan et al.

(10) Patent No.: US 8,800,224 B1
(45) Date of Patent: Aug. 12, 2014

(54) CORROSION INHIBITING VAPOR FOR USE IN CONNECTION WITH ENCASED ARTICLES

(75) Inventors: Margarita Kharshan, Little Canada, MN (US); Alla Furman, Shoreview, MN (US); Jessi Jackson Meyer, Hudson, WI (US)

(73) Assignee: Cortec Corporation, St. Paul, MN (US)

( * ) Notice: Subject to any disclaimer, the term of this patent is extended or adjusted under 35 U.S.C. 154(b) by 913 days.

(21) Appl. No.: 12/871,004

(22) Filed: Aug. 30, 2010

Related U.S. Application Data

(63) Continuation-in-part of application No. 11/559,482, filed on Nov. 14, 2006, now Pat. No. 7,892,601.

(51) Int. Cl.
*B05D 7/22* (2006.01)
*B05D 5/00* (2006.01)

(52) U.S. Cl.
USPC ..... 52/223.1; 52/223.14; 427/237

(58) Field of Classification Search
USPC ..... 427/230–239; 106/14.05; 52/223.1, 52/223.14
See application file for complete search history.

(56) References Cited

U.S. PATENT DOCUMENTS

| | | | |
|---|---|---|---|
| 2,752,221 | A | 6/1956 | Wachter et al. |
| 3,084,022 | A | 4/1963 | Sindery |
| 3,513,609 | A | 5/1970 | Lang |
| 3,979,896 | A | 9/1976 | Klett et al. |
| 4,222,021 | A | 9/1980 | Bunker, Jr. |
| 4,275,835 | A | 6/1981 | Miksic et al. |
| 4,442,021 | A | 4/1984 | Burge et al. |
| 4,840,666 | A | 6/1989 | Schmidt et al. |
| 4,869,752 | A | 9/1989 | Jalkin |
| 5,079,879 | A | 1/1992 | Rodriguez |
| 5,139,700 | A | 8/1992 | Miksic et al. |
| 5,173,982 | A | 12/1992 | Lovett et al. |
| 5,218,011 | A | 6/1993 | Freeman |
| 5,332,525 | A | 7/1994 | Miksic et al. |
| 5,460,033 | A | 10/1995 | Vander Velde |
| 5,540,030 | A | 7/1996 | Morrow |
| 5,597,514 | A | 1/1997 | Miksic et al. |
| 5,715,945 | A | 2/1998 | Chandler |
| 5,750,053 | A | 5/1998 | Miksic et al. |
| 5,770,286 | A | 6/1998 | Sorkin |
| 5,840,247 | A | 11/1998 | Dubois et al. |
| 5,902,958 | A | 5/1999 | Haxton |
| 6,028,160 | A | 2/2000 | Chandler et al. |
| 6,174,461 | B1 | 1/2001 | Miksic et al. |
| 6,342,101 | B1 | 1/2002 | Miksic et al. |
| 6,354,596 | B1 | 3/2002 | Rodriguez |
| 6,399,021 | B1 | 6/2002 | Heimann et al. |
| 6,555,600 | B2 | 4/2003 | Sobkin et al. |
| 6,588,193 | B2 | 7/2003 | Hayes |
| 6,858,160 | B2 | 2/2005 | Heimann et al. |
| 7,048,873 | B1 | 5/2006 | Miksic et al. |
| 7,125,441 | B1 | 10/2006 | Furman et al. |

FOREIGN PATENT DOCUMENTS

| | | | |
|---|---|---|---|
| JP | 2003-056121 | A | 2/2003 |

*Primary Examiner* — William Phillip Fletcher, III
(74) *Attorney, Agent, or Firm* — Haugen Law Firm PLLP

(57) ABSTRACT

A volatile corrosion inhibiting agent is provided for dispersion of a vapor phase corrosion inhibitor in a vapor stream that is passed into a sheath or other casing enclosing a metal bar, cable, or other tension member to protect said tension member from corrosion.

11 Claims, 4 Drawing Sheets

CORROSION INHIBITING VAPOR FOR USE IN CONNECTION WITH ENCASED ARTICLES

CROSS-REFERENCE TO RELATED APPLICATIONS

This application is a continuation-in-part of U.S. Non-Provisional application Ser. No. 11/559,482, filed on Nov. 14, 2006 now U.S. Pat. No. 7,892,601 and entitled "Corrosion Inhibiting Powders and Processes Employing Powders", the content of which being incorporated herein in its entirety.

BACKGROUND OF THE INVENTION

The present invention relates to vapor phase corrosion inhibiting compositions, and more particularly to inhibitors specifically formulated to provide corrosion protection of metal in recessed areas or encased, e.g. cables inside tubes.

Vapor phase corrosion inhibiting (VCI) materials are utilized in a variety of applications for protecting metal from corrosion, and generally include chemicals which function as corrosion inhibitors and which are primarily in the solid or liquid state at ambient temperatures, but which exhibit a small but significant vapor pressure. This volatility enables the corrosion inhibitors to migrate in the vapor phase to effectively protect proximate metal surfaces. Example vapor phase corrosion inhibitors are described in patent numbers U.S. Pat. Nos. 2,752,221 and 4,275,835 herein incorporated by reference. One prevalent application of VCI materials involves protecting metal in an enclosed space, such as electronics in a closed chassis or a metal article in a sealed package. In such situations, a vapor permeable packet containing VCI material can be inserted in the enclosure to provide corrosion protection to corrosion-susceptible items within the enclosure for an extended period of time (up to several years). However, experience has shown that there are limits to the above approach. In non-closed systems, the VCI can be lost to the outside atmosphere. Even in closed systems, the extent of corrosion protection tends to diminish at distances more than several feet from the VCI material packet. This is particularly problematic in enclosures with a high aspect ratio (e.g. inside a pipe). For this reason, a number of alternate delivery vehicles have been developed to extend the use VCI materials to a wider variety of applications. Example VCI delivery vehicles are described in U.S. Pat. Nos. 3,084,022, 5,715,945, 5,332,525, 6,028,160, and 6,555,600.

A particular VCI application involves the protection of structural cables from corrosion. Structural cables are perhaps most commonly observed in suspension and cable stay bridges. Here, they may be thousands of yards long, several feet in diameter and represent a significant long term investment. Structural cables are also a key component in a method of prestressing concrete structures, known as post-tensioning. Post-tensioned concrete systems have been used for decades in the construction of bridges, elevated concrete slabs for parking ramps and garages, and in flooring, walls and columns of commercial buildings. In this form of prestressing, cables, strands, bars, or other members of high strength steel are installed at a job site, usually housed in sheathing or tubes that prevent the steel from bonding to the concrete. After the concrete cures, the steel members are stretched by hydraulic jacks. The tensioned members act upon the concrete slab or other structure to place it in compression, considerably improving the capacity of the structure to withstand tensile and bending forces.

The term "elongate metal tension member" is used herein to refer generically to, for example, metal cables, wires, strands, bars and other elongated forms that that are used under tension to provide structural strength and/or support to another material and/or structure.

A persistent problem with elongate metal tension members is corrosion of the metal, particularly in environments involving exposure to salts and other environmental treatment materials (e.g. de-icing chemicals), acid rain, airborne salts in locations near the ocean, and high humidity. If undetected or untreated, corrosion can weaken metal tension members to the point of breakage. In typical post-tensioned structures where the cables or other members are not bonded to the surrounding concrete, breakage of a tensioned member can create a risk of serious injury and property damage. For cables and other tension members in a bridge, corrosion can weaken the integrity of the support systems leading to use restrictions, expensive repairs, premature bridge replacement, or catastrophic failure.

For post tensioned systems, a variety of solutions have been directed to the corrosion problem. For example, U.S. Pat. No. 5,840,247 (Dubois et al.) discloses a process for protecting the tendons embedded in housings by drilling holes in the housings and injecting a corrosion inhibiting liquid solution into the housings while applying a high power pulsating wave to enhance penetration.

U.S. Pat. No. 5,460,033 (VanderVelde) describes processes for corrosion evaluation and protection of unbonded cables. Holes are drilled in the concrete to expose the tendons, and a dry non-corrosive gas is passed through the conduits enclosing the tendons. The patent notes that if the evaluation of the gas indicates a humidity above sixty percent, corrosion will ensue. The humidity preferably is maintained below forty-five percent, by injection of dry nitrogen gas as needed.

U.S. Pat. No. 3,513,609 (Lang) shows tendons coated with a polymeric material such as Teflon (brand name) or an epoxy resin containing up to twenty-five percent finely ground Teflon polymer. The tendons are coated with a lubricating grease before they are covered with the plastic.

U.S. Pat. No. 4,442,021 (Burge, et al.) is drawn to a corrosion protection coating of cement containing up to ten percent corrosion inhibitors. The mixture is applied onto the metallic tendons before their enclosure.

U.S. Pat. No. 5,770,286 (Sorkin) describes a corrosion resistant retaining seal for end caps. The cap, formed of a polymeric material, contains corrosion resistant material inside the cap. The cap is intended to create a water-tight seal. The patent also describes an "ice pick" method of making a hole in the plastic sheath and injecting grease into the sleeve to displace water and prevent corrosion.

U.S. Pat. No. 5,540,030 (Morrow) describes injecting a polyurethane resin into the housing to displace water and air and prevent corrosion.

While the foregoing approaches are acceptable for a variety of applications, none of them is particularly well suited for providing corrosion protection for large scale systems in which the tension members may have considerable length, e.g. exceeding one hundred feet. Drilling holes for injecting anti-corrosive grout or oil becomes prohibitively expensive and time consuming, and corrosion of longer lengths of tensioned members is not adequately addressed by end caps or similarly restricted features. Coating tension members directly with anti-corrosive layers or films inhibits corrosion, but is not a practical approach for treating previously installed systems.

Cables used in bridges may be coated/treated at or before installation to inhibit corrosion. Further, the cables may be encased in a moisture impermeable protective sheath to further protect the cables from corrosion. However, these measures sometimes prove insufficient, and there is a need for cost effective post treatments to further inhibit corrosion.

U.S. Pat. No. 5,173,982 (Lovett et al.) describes a system for protection of cable assemblies in cable-stay bridges. Here, a corrosion resistant fluid is used to fill the space between the cable and sheath, from the top anchor (on a tower) to the lower anchor (bridge deck) for each cable. A reservoir on the top of the tower is used to fill each cable assembly. While potentially effective at reducing or eliminating corrosion, the approach has some disadvantages. First, the vertical distance from the top anchor to the bottom anchor can create significant head pressure at lower portions of the cable sheathing. Any leaks in the sheathing can result in an unintended release of corrosion inhibitor liquid into the environment, as well as loss of corrosion protection in that cable assembly. Further, on a large bridge, this may require the acquisition and handling of large quantities of corrosion inhibitor fluids.

U.S. patent application Ser. No. 11/559,482 (assigned to the present assignee) provides solution to some of the above problems. The application describes methods and systems for the prevention of corrosion, which use a powder aerosol containing volatile corrosion inhibitors. The aerosol is blown into the space between a metal tensioning element and sheath leaving powdered volatile corrosion inhibitors in place to protect the metal. However, the handling of the powder aerosol can be a concern with respect to employee safety (inhalation and explosion) as well as environmental release.

Accordingly, the present invention concerns structures, systems, and processes directed at least to one or more of the following objects:

(1) to facilitate corrosion protection of metal tension members having considerable length, without the need to drill multiple holes along the length of the members to be treated;

(2) to provide a process for treating tensioned reinforcement members in situ in preexisting structures, at low cost and minimal disruption to the structures and minimal safety and environmental risks;

(3) to provide a process particularly well suited for protecting reinforcement members (either before or after they are tensioned) enclosed in relatively tight tubes or sheaths, or having irregular or varying topographies or otherwise forming relatively small or deep voids where exposed metal surfaces are difficult to reach.

SUMMARY OF THE INVENTION

To achieve these and other objects, there is provided a corrosion inhibition system. The system includes a vapor stream that occupies substantially the interior volume between an elongate metal tension member and a cover surrounding the tension member. The vapor stream includes a carrier gas and vapor phase corrosion inhibitor.

A volatile corrosion inhibiting (VCI) agent is characterized as being primarily in the solid or liquid state at ambient temperatures and pressures, but with some fraction in the vapor phase at equilibrium. By passing a carrier gas through an enclosed space containing VCI, a vapor stream is created containing some quantity of VCI vapor. This vapor stream can then be used to distribute vapor phase corrosion inhibitor throughout the interior volume. The volatile feature of the chemicals facilitates protection of exposed metal surfaces not accessible by other forms of corrosion inhibiting agents, especially deep recesses and voids within the interior volume. The vapor phase corrosion inhibitor in the vapor stream adsorbs on the exposed metal surfaces of the elongate metal tension members, forming a thin, protective layer that provides continuous protection against corrosion from exposure to moisture, salt, oxygen, carbon dioxide, or other corrosive elements.

If the layer is disturbed by moisture or other corrosive components entering the interior volume, the corrosion inhibiting characteristics remain effective.

In some embodiments, the VCI agent is supplied in a solid form. It can be conveniently supplied as a granular or powdered product. The VCI agent may be enclosed in a vapor permeable pouch or package. The carrier gas is passed through the space surrounding the VCI agent, such that VCI vapor distributes in the carrier gas to become the effective vapor stream containing the vapor phase corrosion inhibitor. The vapor stream is then directed through the interior volume of the structure enclosing the metal tension members, thereby providing corrosion protection thereto. Examples of suitable volatile corrosion inhibiting agents are selected from the group consisting of cyclohexylammonium benzoate, monoethanolammonium benzoate, dicyclohexyl ammonium nitrate, tolytriazole, benzotriazole, their combinations, and other combinations of corrosion inhibitors such as the amine salts of acids such as sebasic acid and caprylic acid that form solids that can be ground into the desired particle size. Cyclohexylammonium benzoate, monoethalnolammonium benzoate, and dicyclohexylammonium nitrate are alternately called cyclohxylamine benzoate, monoethanolamine benzoate, and dicyclohexylamine niotrate, respectively.

Another aspect of the present invention is a process for treating an elongate metal tension member adapted to provide structural support while in tension. The process includes the following steps:

a. generating a vapor stream including a dry carrier gas, and a vapor phase corrosion inhibiting agent with an affinity for metal surfaces; and b. introducing the vapor stream into an interior of a substantially fluid impermeable casing disposed in surrounding relation to an elongate metal tension member until the vapor stream substantially fills an interior volume comprised of the interconnected interstitial voids between the tension member and the casing.

Cables and other tension members can be treated before and/or after they are tensioned. Preferably, the VCI agent is supplied in a solid form. It can be conveniently supplied as a granular or powdered product. The VCI solid may be enclosed in a vapor permeable pouch or package. The carrier gas is passed through the space surrounding the VCI agent, such that VCI vapor distributes in the carrier gas to become the effective vapor stream. The vapor stream is introduced to the interior volume through an entrance passage, preferably near a first end region of the tension member. Simultaneously, the interstitial volume is evacuated by allowing flow through an exit passage, preferably near an opposite end region of the tension member. For long tensioning members, multiple entrances and exits over the length of the casing may be used with this process. Flow of the vapor stream through the enclosed space may be facilitated by positive pressure applied to the entrance or suction applied to the exit or both.

Another aspect of the present invention is a process for treating and encased tension member in situ. The process includes the following steps:

a. forming an entrance passage from an exterior of an assembly including a tension member and a fluid impermeable cover to an interior volume between the tension member and the cover;

b. forming an exit passage from the interior volume to the exterior, spaced apart from the entrance passage;

c. generating a vapor stream including a carrier gas, and vapor phase corrosion inhibitor dispersed in the carrier gas;

d. introducing the vapor stream into the interior volume through the entrance passage while simultaneously allowing a flow out of the interior volume through the exit passage, to substantially fill the interior volume with the vapor stream; and e. with the interior volume substantially filled with the vapor stream, closing the entrance passage and the exit passage to maintain the vapor phase corrosion inhibitor inside the cover.

The process is particularly well suited for treating previously installed tension members in preexisting structures, particularly when the encased tension members have lengths exceeding 50, 100, and even 150 feet. This is primarily because the only required access to the interior volume inside the cover is an entrance passage formed at one end of the tension member and cover apparatus, and an exit passage at the other end of such apparatus. There is no need for intermediate passages for pumping oil or greases into the interior volumes at high pressure. Rather, in accordance with the invention, the vapor stream is provided into the interior volume through the entrance passage at low pressure, for example using a fan, blower, or air compressor at a pressure of less than 10 psi. The vapor stream advances through the interior volume lengthwise of the tension member due to the continued positive pressure, while gases previously present in the interior volume flow out of the interior volume through the exit passage.

Thus, in accordance with the present invention, a relatively simple and low cost method of treating encased tension members can be utilized both before and after the members are initially tensioned, or in the course of normal inspection of previously installed tension members years after a project is completed. In either event, the corrosion protection is enhanced by the capacity of the vapor phase corrosion inhibitor agent to migrate into deep recesses and voids to reach virtually all exposed metal surfaces.

BRIEF DESCRIPTION OF THE DRAWINGS

Further features and advantages will become apparent upon consideration of the following detailed description and drawings, in which.

DETAILED DESCRIPTION OF THE PREFERRED EMBODIMENTS

Figure 1:
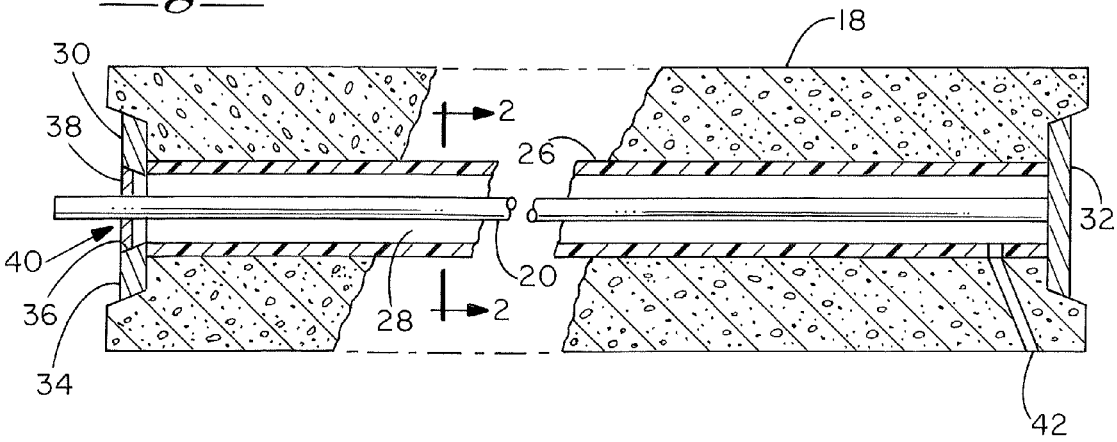
FIG. 1 is a sectioned elevational view of a concrete structure reinforced with a post-tensioned cable treated in accordance with the present invention.
Figure 2:
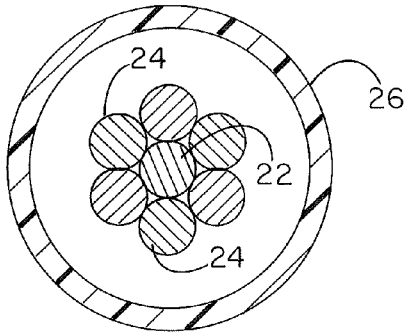
FIG. 2 is a sectional view taken along the line 2-2 in FIG. 1.
Figure 3:
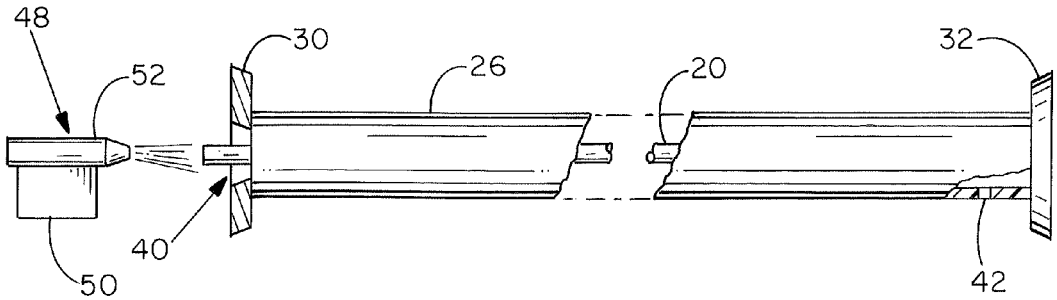
FIG. 3 is a schematic view illustrating a process for treating metal tension members in the course of forming reinforced concrete structures in accordance with the present invention.

Turning now to the drawings, there shown in FIGS. 1-3, a post-tensioning assembly 16 employed to prestress a concrete slab 18. The concrete slab may be a section of a bridge, a parking deck or ramp, wall, floor, or any other structure in which structural sections can be formed of reinforced concrete.

The assembly includes an elongate tension member in the form of a high-strength steel cable 20 consisting of a center strand 22 surrounded by a plurality of peripheral strands 24 wound in a tight helical configuration about center strand 22. In alternative embodiments, the tension member may be a rod, bar, single strand, or plurality of strands, either unwound or wound in a configuration other than a helical configuration of strands 24.

Cable 20 is housed within a sheath 26. The sheath provides a cover or casing that surrounds the cable over the complete length of the cable contained within slab 18. Sheath 26 ensures that cable 20 remains unbonded, i.e. free to move axially relative to the slab, to permit stretching the cable to place it under tension to prestress the slab. Sheath 26 typically is formed of a polymeric material, and provides a substantially fluid impermeable barrier between slab 18 and cable 20. Sheath 26 tends to isolate the cable and the enclosed sheath interior space, i.e. an interior volume 28, from the outside environment.

While this fluid isolation provides a degree of protection against corrosion of the steel, corrosive components can and do infiltrate the interior volume. Accordingly, in conventional post-tensioning systems, it is known to inject corrosion inhibiting greases into the interior volume 28 to reduce and counteract such exposure. These greases, however, tend to harden and dry, and even at the outset may fail to reach exposed metal surfaces in deep pockets or crevices of the interior volume.

Typically, post-tensioning systems employing multiple assemblies such as assembly 16 are installed on a job site, by positioning the cables or other tendons and their surrounding sheaths before the concrete is poured. At their opposite ends, the cables are secured by anchors, as indicated with respect to cable 20 by opposite anchors 30 and 32. Anchor 30 includes an anchoring body 34 having a frusto-conical central opening 36 surrounding cable 20 and containing several anchoring wedges 38. Wedges 38, in the manner known in the art, allow cable 20 to be stretched axially, to the left as viewed in FIG. 1, whereupon the wedges converge to secure the stretched cable against slippage relative to anchor 30.

In contrast, the opposite end of cable 20 is fixed with respect to anchor 32. In alternative systems, it may be advantageous or desirable to use anchors such as anchor 30 at both ends, to allow tensioning of the cable at either end of slab 18.

The concrete is allowed to cure before the cables of the prestressing system are stretched. With a specific reference to cable 20, anchors 30 and 32 secure the opposite cable ends, and are adapted to apply compressive forces to the slab to counterbalance the tension of cable 20 when stretched. A hydraulic jack or other equipment (no shown) is used to stretch the cable to the desired tension. Locking wedges 38 maintain the desired tension after the jack is disconnected from the cable.

Figure 5:
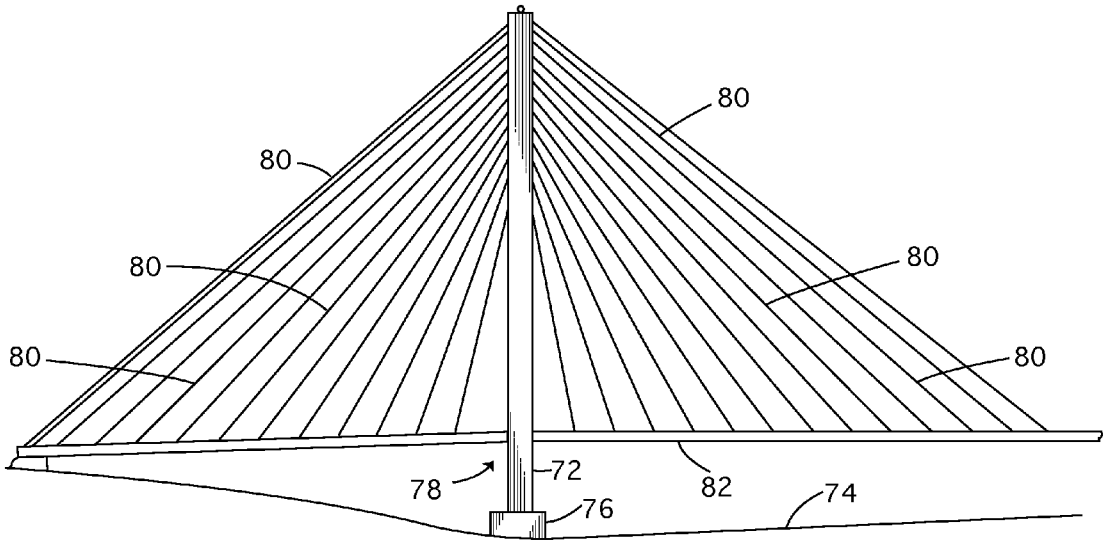
FIG. 5 is an elevation view of a cable-stayed bridge.
Figure 6:
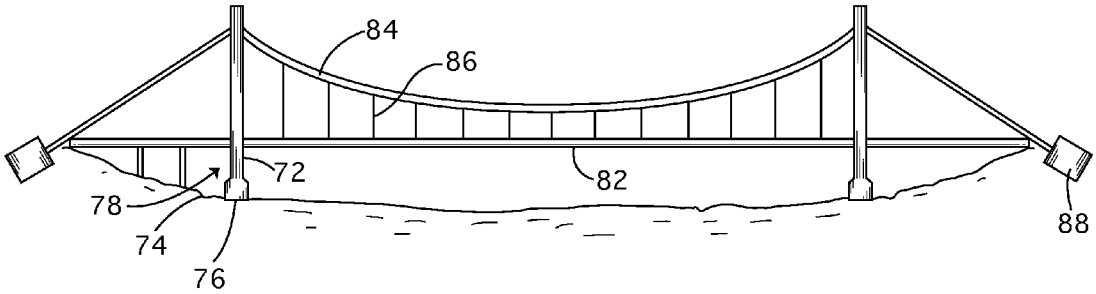
FIG. 6 is an elevation view of a suspension bridge.

Tension cables are commonly used in a variety of structural supports. In a cable-stay bridge (FIG. 5), for example, cables 80 are connected directly between upright support members 72 of a support tower 78 and the bridge deck 82. Each cable is suitably anchored on the upright support member 72 and the bridge deck 82. Here, the support tower 78 is supported in the ground 74 via a foundation or footing 76. A suspension bridge (FIG. 6) contains many of the same structural elements as a cable-stay bridge (support tower 78, with footing 76 and upright member 72; bridge deck 82). However, in a suspension bridge, a main cable assembly 84 is suspended between support members 72, and typically anchored to the ground 74 on both ends of the bridge. The main cable assembly 84 is connected to the bridge deck 82 by means of vertical hangers 86, which themselves may contain cables, strands, bars, or rods capable of supporting a sustained load. The basic structure of bridge cables is also generally represented by FIG. 2, with a plurality of strands 22, 24 surrounded by a protective sheath 26. Depending on the specific bridge size and design, multiple smaller cables may be bundled into larger cable assemblies, surrounded by an outer sheath or conduit.

For both bridge cables and post-tensioned cables in concrete structures, grease is often applied to the metal tension member for protection from corrosion. However, one of the problems associated with using grease as the corrosion inhibiting medium is the difficulty in filling the interior volume with the medium, primarily due to its high viscosity. This problem is particularly pronounced in larger structures, where cables may exceed one hundred fifty feet in length. While multiple access holes can be drilled along the length of the cable, as taught in the aforementioned Morrow '030 and Dubois '247 patents, this approach adds considerable time and cost to the project, and provides more potential paths for corrosive element infiltration.

In accordance with present invention, a preferred medium for delivering corrosion inhibiting agents to interior volume is a vapor stream: more particularly, a non-reactive carrier gas with vapor phase corrosion inhibitors dispersed in the carrier gas.

Corrosion inhibiting chemicals useful for volatizing or sublimating can be prepared by reacting amines with acids. A useful mixture of inhibitors can be formed from cyclohexylammonium benzoate, monoethanolamonium benzoate and a small amount amorphous silica. Monoethanolammonium benzoate functions well, as does dicyclohexyl ammonium nitrate. Further well-functioning inhibitors include benzotriazole and the monoethanolammonium salt of benzo- or tolyltriazole. Sodium nitrate also can be used, along with a variety of other volatile corrosion inhibiting chemicals.

Example corrosion inhibiting agent composition are formulated by preparing the salts of several amines with benzoic acid or nitric acid, according to the following examples:

| Constituent | Percent by Weight |
|---|---|
| Example 1 | |
| Cyclohexylammonium Benzoate | 87 |
| Monoethanolammonium Benzoate | 10 |
| Amorphous Silica | 3 |
| Example 2 | |
| Cyclohexylammonium Benzoate | 60 |
| Monoethanolammonium Benzoate | 20 |
| Dicyclohexcyl Ammonium Nitrate | 20 |
| Example 3 | |
| Cyclohexylammonium Benzoate | 55 |
| Monethanolammonium Benzoate | 20 |
| Dicyclohexcyl Ammonium Nitrate | 20 |
| Benzotriazole | 5 |

It is advantageous that the inhibitor materials are supplied as dry powders. The powders are preferably enclosed in a porous bag or pouch, to facilitate easy handling. Different VCI agents typically have different equilibrium vapor pressures resulting in different rates of volitization at a given set of conditions. Thus, a blend of VCI agents may be advantageous in providing fast initial distribution of vapor phase corrosion inhibitor into the vapor stream as well as assuring ongoing VCI emissions. For example, more VCI enters the vapor phase in a given amount of time for a material with a "higher" equilibrium vapor pressure (e.g. $>1\times10^{-4}$ mm Hg), in comparison to a VCI with a "lower" equilibrium vapor pressure. The "higher" equilibrium vapor pressure VCI material is therefore deemed to provide "fast" volitization and corrosion protection. In like manner, a VCI material with a "lower" equilibrium vapor pressure is slower to enter the vapor phase, but is also slower to desorb from the surface to be protected, thus providing "longer term" protection.

Dicyclohexyl ammonium nitrate, with a vapor pressure of about $1.3\times10^{-4}$ (mm Hg) at 21° C. is a useful VCI for relatively fast protection from corrosion. Monoethanolammonium Benzoate, with a vapor pressure of about $5\times10^{-4}$ (mm Hg) at 21° C. is also a useful VCI for relatively fast protection from corrosion. Cyclohexylammonium Benzoate, with a lower vapor pressure of approximately $8\times10^{-5}$ (mm Hg) at 21° C., is useful for providing longer term protection. Vapor pressures of example volatile corrosion inhibitors are listed in Table 1 below.

TABLE 1

| Substance | Temperature (° C.) | Vapor Pressure (mm Hg) |
|---|---|---|
| Morpholine | 20 | 8.0 |
| Benzylamine | 29 | 1.0 |
| Cyclohexylammonium Carbonate | 25.3 | 0.397 |
| Diisopropylammonium Nitrite | 21 | $4.84\times10^{-3}$ |
| Morpholine Nitrite | 21 | $3\times10^{-3}$ |
| Dicyclohexylammonium Nitrite | 21 | $1.3\times10^{-4}$ |
| Dicyclohexylammonium Caprylate | 21 | $5.5\times10^{-4}$ |
| Guanadine Chromate | 21 | $1\times10^{-5}$ |
| Hexamethyleneimine Benzoate | 41 | $8\times10^{-4}$ |
| Hexamethyleneimine Nitrobenzoate | 41 | $1\times10^{-6}$ |
| Dicyclohexylammonium Benzoate | 41 | $1.2\times10^{-6}$ |

It has been determined by the Applicants that a combination of VCI materials having disparate vapor pressures provide a desirable vapor phase corrosion inhibitor composition which exhibits both rapid and ongoing corrosion protection. In particular, it has been determined that a constituent blend of a first "fast" volatile corrosion inhibitor having an equilibrium vapor pressure of greater than about $1\times10^{-4}$ mm Hg, and a second "slow" volatile corrosion inhibitor having an equilibrium vapor pressure of less than about $1\times10^{-4}$ mm Hg provides a desirable blend of corrosion protection in, for instance, structural cables in suspension and cable stray bridges. In some embodiments, the VCI composition includes at least about 50% by weight of a "slow" volatizing corrosion inhibitor. The combination of a plurality of volatile corrosion inhibitor constituents is surprisingly effective in placating corrosion, in that the vapor phase corrosion inhibitors dispersed into the interior volume between the tension member and the cover provide a synergistic effect in establishing both immediate and long-lasting corrosion protection. In particular, it has been determined that the use of the above combinations of materials unexpectedly increase the corrosion protection duration of a given treatment of vapor phase corrosion inhibitor, as compared to the corrosion protection duration when using a single inhibitor component.

The dry powder VCI materials used in the examples were passed through an 80 micron screen, and were loaded into one or more pouches defining an enclosure capable of containing up to about 300 g of VCI powder. It is to be understood, however, that various-sized pouches may be utilized in the present invention to fulfill the needs of particular applications. The pouches may preferably be manufactured from a vapor-permeable material, and optionally a vapor-permeable, liquid-impermeable material with pores which are small enough to contain the powdered VCI. While a variety of pouch materials are contemplated by the present invention, example materials found by the Applicants to be useful in the manufacture of the VCI powder-receiving pouches include Tyvec® grades 1059B, 1056D, 1025D, and 8740D. Such materials have suitable porosity along with characteristics such as lightweight, high strength, water resistance, and ease of sealing post-filling. Such materials are commercially available from E.I. du Pont de Nemours and Company.

In some embodiments, dry powder VCI is loaded to an extent to provide at least about 250 g of powder composition per cubic meter of void space to be filled to a desired extent by vapor phase corrosion inhibitor. An exerted vapor pressure of about $1\times10^{-5}$ mm Hg within the void space may be considered sufficient to protect the enclosed cable.

To facilitate loading the vapor stream into interior volume 28, entrance and exit passages are disposed at the opposite ends of the sheath and cable. An entrance passage 40 is provided in the form of gaps between adjacent wedges 38. At the opposite end where cable 20 and anchor 32 are integrally coupled, an exit passage 42 is formed through concrete slab 18.

When interior volume 28 is filled with the vapor stream, the entrance and exit passages may be sealed to contain the vapor stream. The vapor phase corrosion inhibitor adsorbs on the exposed metal surfaces, forming a thin, molecular layer that may provide both cathodic and anodic protection.

FIG. 3 illustrates a process used to load the corrosion inhibiting vapor stream into interior volume 28 of a post-tensioned concrete structure. A vapor stream generator 48 is used to introduce the vapor stream into the internal volume through entrance passage 40 under a positive pressure. The pressure to generator 48 may be produced by a suitable compressor, such as Design 53 pressure blowers available from the Chicago Blower Company, or KT Series Piston Compressors from Atlas Copco, for example. Such compressors are coupled to generator 48 through suitable tubing, including conduit 52. In typical applications, a positive pressure above ambient atmospheric pressure is sufficient, such as between about 1 and 10 psi above ambient atmospheric pressure. At a minimum, such pressure is typically that which is necessary to achieve the minimum acceptable flow rate through conduit 52, and ultimately through interior volume 28.

In the illustrated embodiment, generator 48 includes a container 50 for the VCI agent, hose or conduit 52 coupled to container 50 and entrance passage 40, and a source of gas under pressure (source not shown) such as e.g. a conventional air hose, blower, fan, compressor, or other similar device, as described above. The carrier gas may typically be air, but other non-corrosive gases are also suitable. The carrier gas may preferably be depleted in corrosive compounds such as water, saline aerosols, acids, sulfur compounds, and the like relative to ambient air.

In order to uptake vapor phase corrosion inhibitor to the carrier gas, the interior of container 50, in which one or more VCI powder-filled pouches may be disposed, is exposed to the carrier gas. In one example embodiment, therefore, conduit 52 includes an opening (not shown) in fluid communication with an interior of container 50, such that vapor phase corrosion inhibitor within container 50 may be dispersed in the carrier gas in conduit 52. In other embodiments, conduit 52 may be connected to container 50 at an inlet thereof, such that the carrier gas is forced under pressure into an interior of container 50 shared with the VCI-containing pouches, and an outlet connection at container 50 at which vapor phase corrosion inhibitor dispersed within the carrier gas is forced under pressure into an outlet conduit 52 toward entrance passage 40.

Figure 7:
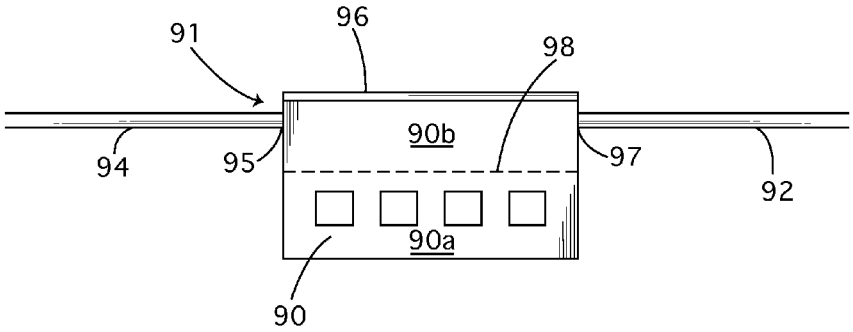
FIG. 7 is a schematic view of a chamber for introducing vapor phase corrosion inhibitor into a vapor stream.

A further example is provided in FIG. 7, wherein chamber 90 of container 91 is configured to receive one or more VCI-filled pouches therein, with chamber 90 being accessible, for example, through a vapor-tight lid 96. In one example, a screen or perforated plate 98 may be included within container 98 so as to divide chamber 90 into a pouch holding section 90*a* and a vapor dispersion section 90*b* at which vapor phase corrosion inhibitor emitted from the VCI-filled pouches at section 90*a* is mixed with the carrier gas passing through chamber 90. Supply of the carrier gas may be provided through a supply conduit 94 coupled to an inlet 95 of chamber 90. An outlet vapor stream, comprising a mixture of carrier gas and vapor phase corrosion inhibitor, may exit chamber 90 through outlet 97 into outlet conduit 92, wherein the vapor stream may be coupled to interior volume 28. In other embodiments, inlet tube 94 and outlet tube 92 may constitute, for example, sheathing of cables used as structural supports in a suspension or cable-stay bridge. In such an embodiment, chamber 90 may be attached directly to the sheathing, and carrier gas may flow through sheathing section 94 through chamber 90, and into sheathing section 92. The cables within the sheathing, in such an embodiment, may pass through chamber 90. In this example, the vapor stream becomes enriched in vapor phase corrosion inhibitor as it passes through chamber 90, to be distributed to cable portions downstream. For long sections of cable, multiple chambers may be positioned at several points along the span to assure effective treatment with vapor phase corrosion inhibitor.

The vapor stream proceeds axially under pressure through interior volume 28. The flow of the vapor stream may be laminar or more turbulent, depending largely upon the shape of the internal volume. In either event, as the vapor stream advances through the interior volume 28, the air or other gas previously in the volume is displaced, and leaves interior volume 28 through exit passage 42. In some embodiments, the vapor stream exiting the passage at 42 may be returned to the vapor generator 48 to create a closed loop.

The introduction of the vapor stream continues at least until the vapor stream substantially fills the interior volume 28. This event generally cannot be detectable visually. Various means can be used to verify that sufficient vapor phase corrosion inhibitor has been distributed in the interior volume. Vapor samples can be collected and analyzed by GC (Gas Chromatography), MS (Mass Spectrometry), or IR (Infrared spectroscopy) to estimate concentration of the VCI present. Alternately, colorimetric test strips produced by the Cortec Corporation under the tradename "VpCI Indicator Strips" may be placed in the interior space near the exit passage 42. The test strips are adapted to change color when the vapor space contains sufficient vapor phase corrosion inhibitor to provide corrosion protection. Other suitable analytical methods may be applied instead or in addition to such test strips. An example vapor pressure of the vapor phase corrosion inhibitor of about $1\times10^{-5}$ mm Hg may be considered to be sufficient to provide the desired corrosion protection.

In some embodiments, typical VCI loading parameters include about 250 g of corrosion inhibiting composition per cubic meter per year in a closed system. The volume factor represents the void space within the enclosure. Thus, for structural supports in, for example, suspension or cable-stay bridges, the void space is attributed to the volume within the sheathing, excluding the volume assumed by the cables.

The generator 48 may be heated to increase the rate of vaporization of the VCI agent and the concentration of agent in the vapor phase. The carrier gas may be heated to accomplish a similar purpose. Generally, the log of vapor pressure of VCI varies linearly with the inverse of temperature. For example, the vapor pressure of cyclohexylammonium benzoate is about $8\times10^{-5}$ at 21° C., but is about $5\times10^{-5}$ at 17° C. and about $11\times10^{-5}$ at 25° C. Because increased equilibrium vapor pressures correspondingly increase the initial rate of VCI vaporization, it may be advantageous in some embodiments to provide heating of the carrier gas or VCI source to facilitate faster vaporization of the volatile corrosion inhibiting agent. In one embodiment, the system may initially be operated at an elevated temperature to facilitate rapid corrosion protection, and subsequently cooled to ambient temperature for ongoing treatment.

After filling interior volume 28 with vapor phase corrosion inhibitor to a desired extent, the entrance and exit passages may be closed to contain the vapor phase corrosion inhibitor. Alternately, treatment may continue on an ongoing basis by maintaining a periodic or continuous flow of vapor stream through the interior volume 28. In such an arrangement, the source of VCI agent may be replenished from time to time.

Figure 4:
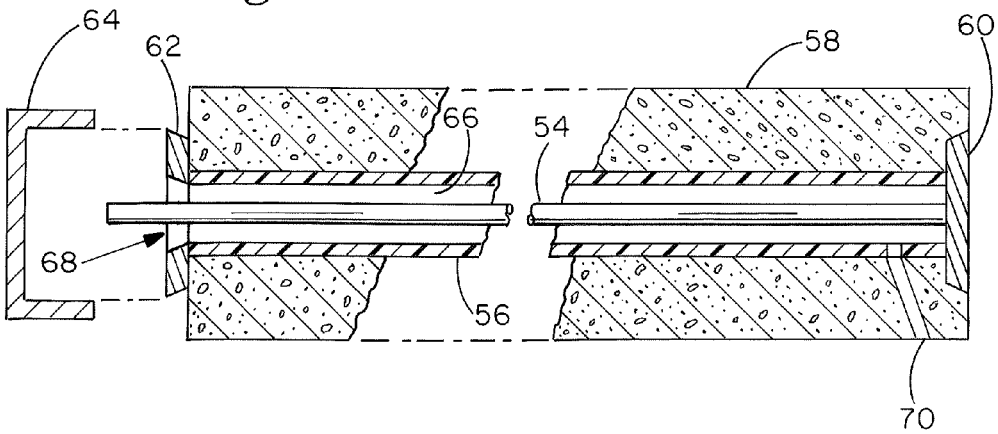
FIG. 4 schematically illustrates a process for treating the metal tension members of a prestressed concrete structure in situ according to the invention.

One advantage of the present invention is the capacity to treat post-tensioning assemblies in previously installed reinforced concrete structures. FIG. 4 illustrates a tension cable 54 surrounded by sheath 56 embedded in a concrete slab 58. Cable 54 acts through anchors 60 and 62 to apply compressive forces to the concrete slab. Cable 54 is attached integrally to anchor 60 and secured to anchor 62 through wedges or other structure that permits axial movement to stretch the cable, as before. Anchor 62, and an end region of cable 54 extending beyond anchor 62, are enclosed by an end cap 64, for example of the type disclosed in U.S. Pat. No. 5,770,286. Anchor 60 likewise, may be covered with an end cap, although this is not illustrated.

Corrosion inhibiting treatment of cable 54 begins with formation of opposite end entrance and exit passages in fluid communication with an interior volume 66. The entrance passage 68 is formed by removing end cap 64, and may also require removal of the grease from between adjacent wedges.

The exit passage is drilled through the concrete and sheath, as indicated at 70. At this stage, the corrosion inhibiting vapor stream is introduced into the interior volume 66, as before. The passages can be functionally reversed if desired, with the vapor stream provided under positive pressure through passage 70, with displaced gasses leaving through the gaps between the wedges. In either event, once the internal volume is filled with the vapor stream, passage 68 may be closed and sealed, using an end cap if desired, and passage 70 may be closed and sealed with a corrosion inhibiting grout.

In cases where there are no end caps, the entrance and exit passages are formed by drilling through the concrete and sheath, and sealed with corrosion inhibiting grout after the vapor stream is introduced.

Thus in accordance with the present invention, corrosion inhibiting agents are applied through a vapor flow process that distributes the vapor phase corrosion inhibitor throughout an enclosed space surrounding a cable, bar or other tension member providing post-tensioning or other structural support. The process is relatively simple and low cost, yet provides substantially complete coverage of exposed metal surfaces for effective and long-term corrosion protection. The process can be integrated into the fabrication of reinforced concrete structures and other structural components, or may be applied in situ to previously completed structures.

What is claimed is:

1. A corrosion inhibition system, including:

an elongate metal tension member, a cover disposed in surrounding relation to the tension member and cooperating with the tension member to define an interior volume between the tension member and the cover, a vapor stream comprising a carrier gas motivated in a proximity to a volatile corrosion inhibiting agent composition to cause dispersal within said carrier gas of a vapor phase corrosion inhibitor, said vapor stream being motivated into said interior volume, and said volatile corrosion inhibiting agent composition comprising at least a first fast volatile corrosion inhibitor and a second slow volatile corrosion inhibitor.

2. The system of claim 1 wherein:

the volatile corrosion inhibiting agent composition is supplied in solid form.

3. The system of claim 2 wherein:

the volatile corrosion inhibiting agent composition is selected from the group of compounds consisting of: cyclohexylammonium benzoate, monoethanolammonium benzoate, dicyclohexcyl ammonium nitrate, benzotriazole, tolytriazole, amine salts of caprylic acid and sebasic acid, and their combinations.

4. The system of claim 3, including at least about 250 grams of said volatile corrosion inhibiting agent composition per cubic meter of said interior volume.

5. The system of claim 1 wherein:

the fast volatile corrosion inhibitor has an equilibrium vapor pressure of greater than about $1\times10^{-4}$ mm Hg at 21° C., and the slow volatile corrosion inhibitor has an equilibrium vapor pressure of less than about $1\times10^{-4}$ mm Hg at 21° C.

6. The system of claim 5, including at least about 50% by weight of said fast volatile corrosion inhibitor.

7. The system of claim 1 wherein:

said vapor stream is motivated by at least one of a fan, a blower, a compressor, and a pump.

8. The system of claim 1 wherein:

said carrier includes less corrosive vapors or aerosols relative to ambient atmosphere external to said cover.

9. The system of claim 1 further including at least one testing device to confirm the presence of said vapor phase corrosion inhibitor in said vapor stream.

10. A process for treating an encased tension member in situ, including:

forming an entrance passage from an exterior of an assembly including a tension member and a fluid impermeable cover to an interior volume between the tension member and the cover;

forming an exit passage from the interior volume to the exterior, spaced apart from the entrance passage;

generating an vapor stream including a carrier gas and a vapor phase corrosion inhibitor; and introducing the vapor stream into the interior volume through the entrance passage while simultaneously allowing a flow out of the interior volume through the exit passage, to substantially fill the interior volume with the vapor stream.

11. The process of claim 10 wherein:

the assembly is surrounded by a concrete structure; and forming at least a selected one of the entrance and exit passages comprises drilling a hole through the concrete structure to the assembly, and closing the passages comprises applying an anti-corrosive grout to close the selected passage.

* * * * *